US008092729B2

(12) United States Patent
Lundgreen et al.

(10) Patent No.: US 8,092,729 B2
(45) Date of Patent: Jan. 10, 2012

(54) INSULATION FOR A STEAM CARRYING APPARATUS AND METHOD OF ATTACHMENT THEREOF

(75) Inventors: James Michael Lundgreen, Lakeville, MN (US); David Baird, Bloomington, MN (US); Joseph T. Haag, Delano, MN (US); Mark Allen Kirkwold, Eden Prairie, MN (US); Scott Allen Nuteson, Woodbury, MN (US)

(73) Assignee: Dristeem Corporation, Eden Prairie, MN (US)

( * ) Notice: Subject to any disclaimer, the term of this patent is extended or adjusted under 35 U.S.C. 154(b) by 0 days.

(21) Appl. No.: 12/817,721

(22) Filed: Jun. 17, 2010

(65) Prior Publication Data

US 2010/0251548 A1 Oct. 7, 2010

Related U.S. Application Data

(62) Division of application No. 11/521,083, filed on Sep. 13, 2006, now Pat. No. 7,744,068.

(51) Int. Cl.
*B01F 3/04* (2006.01)

(52) U.S. Cl. ..... 264/46.9; 261/118; 261/DIG. 76

(58) Field of Classification Search ..... 261/115, 261/116, 117, 118, DIG. 10, DIG. 76; 264/46.4, 264/46.7, 46.9
See application file for complete search history.

(56) References Cited

U.S. PATENT DOCUMENTS

| | | | |
|---|---|---|---|
| 2,963,284 | A | 2/1957 | Brandford |
| 3,386,659 | A | 6/1968 | Rea |
| 3,857,514 | A | 12/1974 | Clifton |
| 4,257,389 | A | 3/1981 | Texidor et al. |
| 4,265,840 | A | 5/1981 | Bähler |
| 5,126,080 | A | 6/1992 | Morton et al. |
| 5,277,849 | A | 1/1994 | Morton et al. |
| 5,376,312 | A | 12/1994 | Morton et al. |
| 5,543,090 | A | 8/1996 | Morton et al. |
| 6,378,562 | B1 | 4/2002 | Noone et al. |
| 6,398,196 | B1 | 6/2002 | Light et al. |
| 6,485,537 | B2 | 11/2002 | Brilmaker |

(Continued)

FOREIGN PATENT DOCUMENTS

| | | |
|---|---|---|
| DE | 25 29 057 | 2/1977 |

(Continued)

OTHER PUBLICATIONS

Zotefoams Inc., Zotek® F—High Performance PVDF Foams (for Buildings and Construction)—"Taking foam technology to a new level," pp. 1-2.

(Continued)

*Primary Examiner* — Charles Bushey
(74) *Attorney, Agent, or Firm* — Merchant & Gould P.C.

(57) ABSTRACT

A steam dispersion system including insulation is disclosed. The steam dispersion system may include a steam dispersion tube with at least one opening defined on an outer surface of the steam dispersion tube and a hollow interior. The insulation covers at least a portion of the steam dispersion tube, the insulation defining an opening aligned with the opening of the steam dispersion tube, wherein the insulation meets 25/50 flame/smoke indexes for UL723/ASTM E-84 and has a thermal conductivity less than about 0.35 Watts/m-K (2.4 in-hr/ft^2 deg F.). A nozzle defining a throughhole may be placed within the opening of the steam dispersion tube, the throughhole being in fluid communication with the hollow interior of the steam dispersion tube to provide a steam exit.

5 Claims, 7 Drawing Sheets

U.S. PATENT DOCUMENTS

| | | | | |
|---|---|---|---|---|
| 6,488,219 | B1 | 12/2002 | Herr | |
| 6,631,856 | B2 | 10/2003 | Herr | |
| 7,048,958 | B2 | 5/2006 | de Jong et al. | |
| 7,150,100 | B2 | 12/2006 | Tase et al. | |
| 7,395,588 | B2 * | 7/2008 | Taniguchi et al. | 28/104 |
| 2001/0045674 | A1 | 11/2001 | Herr | |
| 2002/0089075 | A1 | 7/2002 | Light et al. | |
| 2004/0182855 | A1 | 9/2004 | Centanni | |
| 2006/0042057 | A1 * | 3/2006 | Taniguchi et al. | 28/104 |

FOREIGN PATENT DOCUMENTS

| | | |
|---|---|---|
| GB | 1 444 992 | 10/1972 |

OTHER PUBLICATIONS

Zotefoams Inc., Zotek® F—High Performance PVDF Foams (for Aviation and Aerospace—"Taking foam technology to a new level," pp. 1-4.

Zotefoams Inc., Zotek® F—High Performance PVDF Foams—"Taking foam technology to a new level," pp. 1-4.

Zotefoams Inc., Zotek® F—High Performance PVDF Foams (New Light Weight Materials—Inspiration for Design Innovation)—"Taking foam technology to a new level," pp. 1-6, Dec. 23, 2008.

* cited by examiner

INSULATION FOR A STEAM CARRYING APPARATUS AND METHOD OF ATTACHMENT THEREOF

CROSS-REFERENCE TO RELATED APPLICATION

This application is a divisional of application Ser. No. 11/521,083, filed Sep. 13, 2006, now U.S. Pat. No. 7,744,068, issued on Jun. 29, 2010, which application is incorporated herein by reference in its entirety.

TECHNICAL FIELD

The principles disclosed herein relate generally to the field of steam dispersion humidification. More particularly, the disclosure relates to insulation used on parts of steam dispersion systems to control unwanted condensate and heat gain, and the method of attachment thereof.

BACKGROUND

In the humidification process, steam is normally discharged from a steam source as a dry gas or vapor. As steam mixes with cooler duct air, some condensation takes place in the form of water particles. Within a certain distance, the water particles are absorbed by the air stream within the duct. The distance wherein water particles are completely absorbed by the air stream is called absorption distance. Another term that may be used is a non-wetting distance. This is the distance wherein water particles or droplets no longer form on duct equipment (except high efficiency air filters, e.g.). Past the non-wetting distance, visible wisps of steam (water droplets) may still be visible, for example, saturating high efficiency air filters. However, other structures will not become wet past this distance. Absorption distance is typically longer than the non-wetting distance and occurs when visible wisps have all disappeared and the water vapor passes through high efficiency filters without wetting them. Before the water particles are absorbed into the air within the non-wetting distance and ultimately the absorption distance, the water particles collecting on duct equipment may adversely affect the life of such equipment. Thus, a short non-wetting or absorption distance is desirable.

The conventional configuration of steam dispersion systems used to achieve a short non-wetting or absorption distance consists of multiple, closely spaced dispersion tubes. The number of tubes and their spacing are based on the needed non-wetting or absorption distance. The dispersion tubes can get very hot (e.g., around 212F. on outer surface). A large number of hot tubes heat the duct air, resulting in wasted energy in the cooling and humidification process. Moreover, cool air (e.g., at 50-70F.) flowing around the hot dispersion tubes condenses a portion of the steam within the dispersion tubes. The condensate is often wasted to a drain.

What is needed in the art is an insulation material that can be used with the steam dispersion tubes and other parts of a steam dispersion system that effectively reduces condensate and heat gain, which is also easy to attach.

SUMMARY

The principles disclosed herein relate to insulation for use on steam dispersion tubes and/or other parts of a steam dispersion system and a method of attachment thereof.

In one particular aspect, the disclosure is directed to a steam dispersion system including a steam carrying apparatus and insulation including a polyvinylidene fluoride fluoropolymer covering at least a portion of the steam carrying apparatus.

In another particular aspect, the disclosure is directed to a method of attaching an insulation material to a steam carrying apparatus.

A variety of additional inventive aspects will be set forth in the description that follows. The inventive aspects can relate to individual features and combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
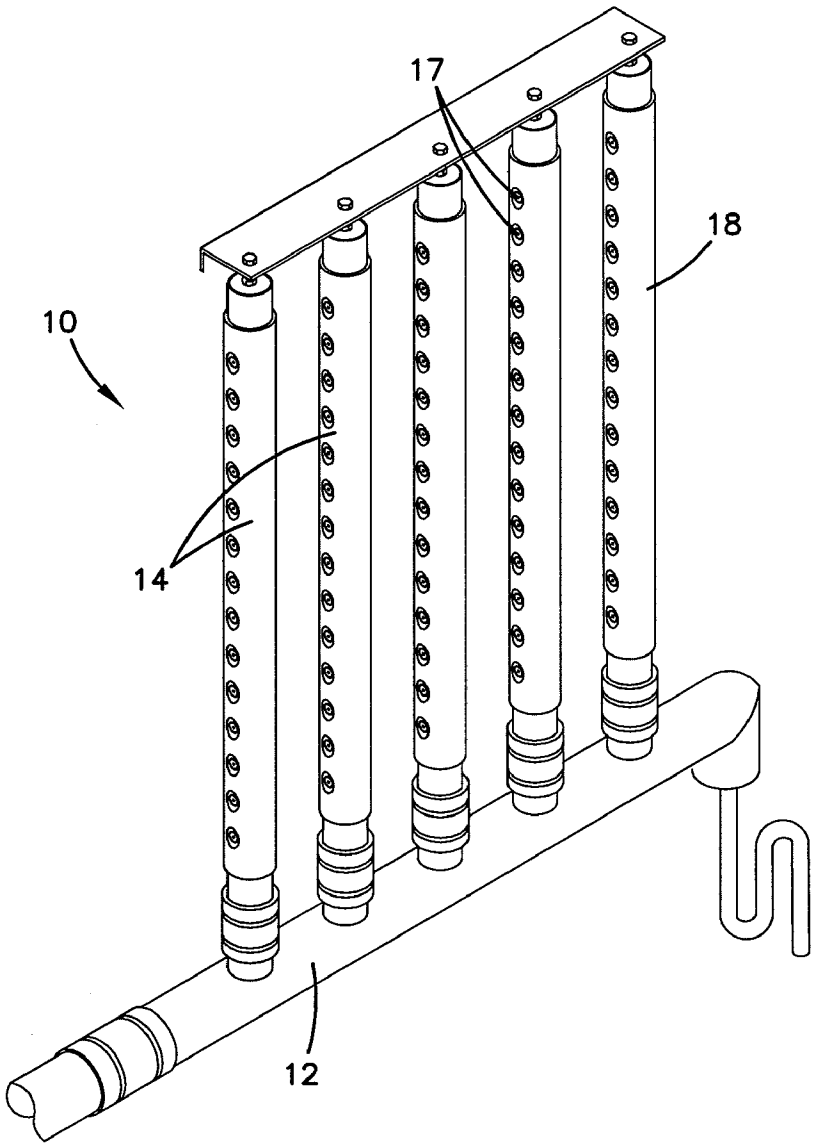
FIG. 1 is a perspective view of an example steam dispersion system including steam dispersion tubes covered with insulation having features that are examples of inventive aspects in accordance with the principles of the present disclosure.

A steam dispersion system 10 having features that are examples of inventive aspects in accordance with the principles of the present disclosure is illustrated in FIG. 1. The steam dispersion system 10 includes a steam header 12 and a plurality of steam dispersion tubes 14 extending from the header 12. The header 12 receives steam from a steam source, such as a boiler (not shown), and the steam is dispersed into duct air through steam delivery points 17 of the steam dispersion tubes 14. The steam dispersion tubes 14, as depicted in FIG. 1, are covered with insulation 18 having features that are examples of inventive aspects in accordance with the principles of the present disclosure.

Figure 2:
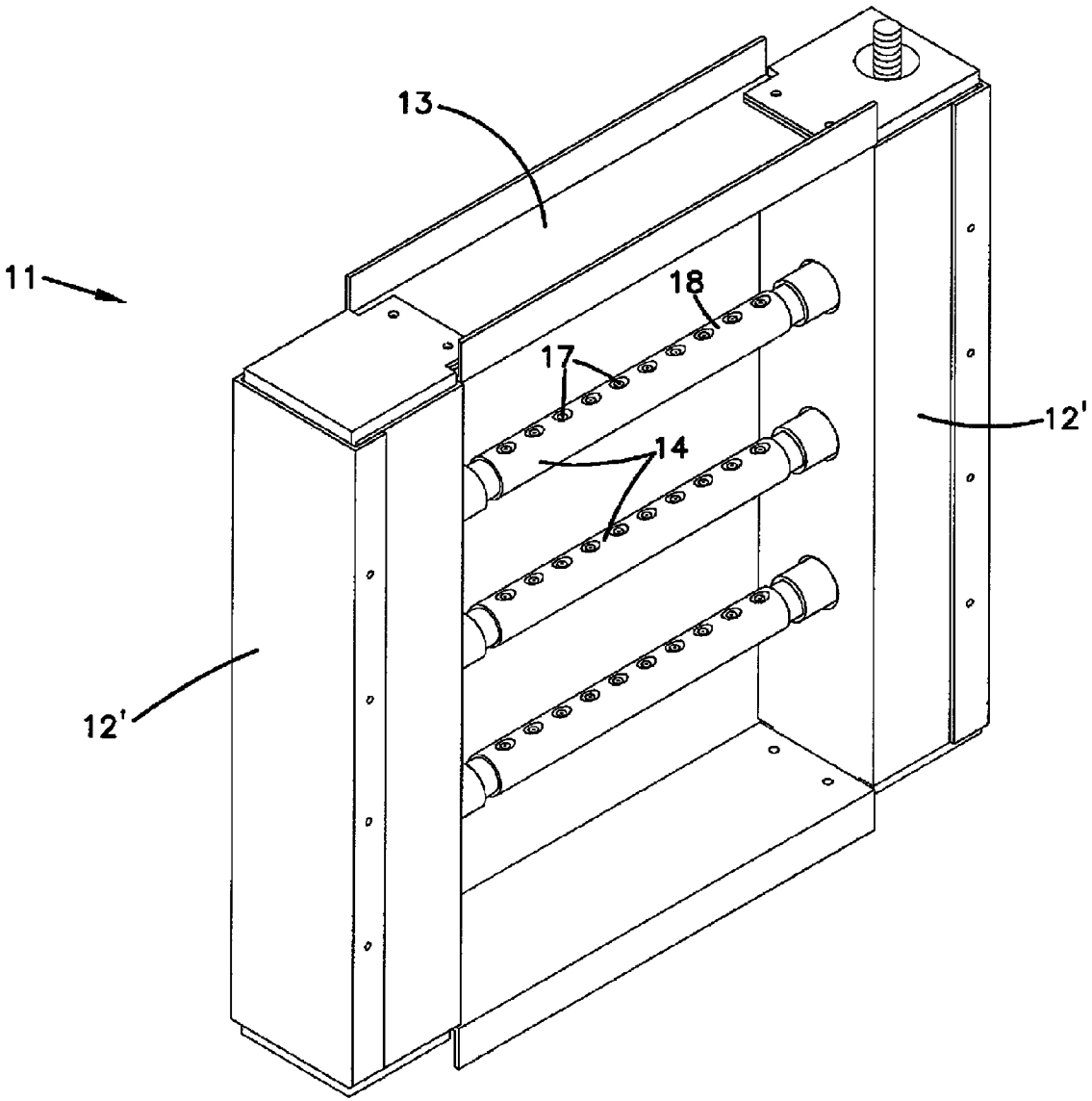
FIG. 2 is a perspective view of another example steam dispersion system including steam dispersion tubes covered with insulation having features that are examples of inventive aspects in accordance with the principles of the present disclosure.
Figure 3:
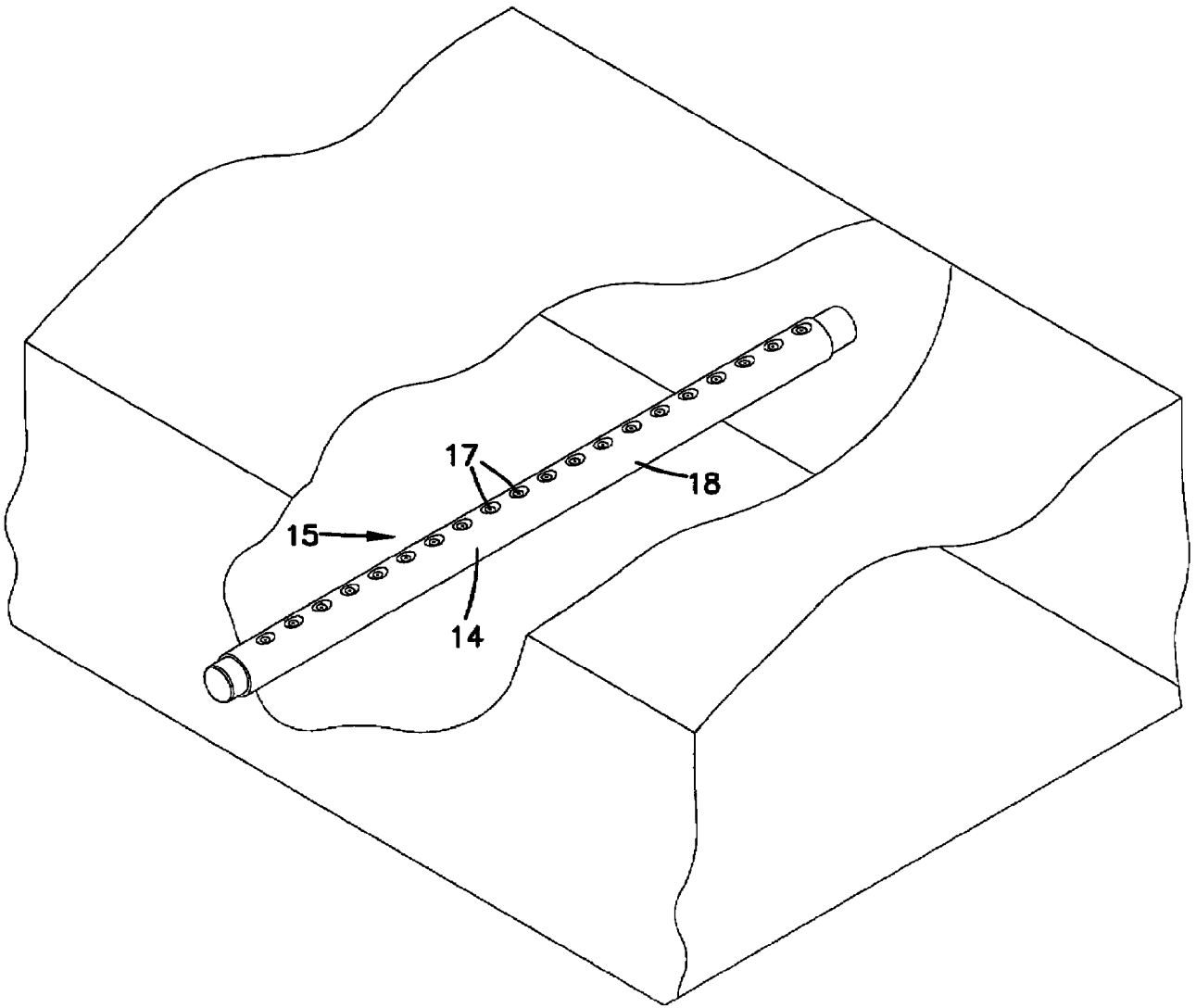
FIG. 3 is a perspective view of yet another example steam dispersion system including a single steam dispersion tube covered with insulation having features that are examples of inventive aspects in accordance with the principles of the present disclosure.

It should be noted that the steam dispersion system 10 illustrated in FIG. 1 is simply one example system with which the insulation 18 having features that are examples of inventive aspects in accordance with the principles of the present disclosure can be used. Other systems are certainly possible. For example, FIG. 2 illustrates another example of a steam dispersion system 11 including steam dispersion tubes 14 covered with the insulation 18 having features that are examples of inventive aspects in accordance with the principles of the present disclosure. The steam dispersion system 11 illustrated in FIG. 2 is similar to the system 10 illustrated in FIG. 1 except that the system 11 illustrated in FIG. 2 includes a four-sided mounting frame 13 and two headers 12' surrounding the steam dispersion tubes 14. FIG. 3 illustrates yet another example of a steam dispersion system 15 using the insulation 18 having features that are examples of inventive aspects in accordance with the principles of the present disclosure. The system illustrated in FIG. 3 includes a simpler design than the systems illustrated in FIGS. 1 and 2 and simply consists of one steam dispersion tube 14 that is covered with the insulation 18.

It should also be noted that, although in the Figures only the steam dispersion tubes 14 of the systems 10, 11, and 15 are shown to include insulation 18, in other embodiments, the insulation 18 can be included on other portions of the steam dispersion systems, such as the header 12 (FIG. 1), etc. In fact, the insulation 18 can be provided on any portion (exterior or interior) of any steam carrying apparatus or system, a number of examples of which have been illustrated in FIGS. 1-3.

The steam dispersion tubes 14 of the steam dispersion systems 10, 11, and 15 depicted in the Figures are simply one example apparatus that can include the insulation 18 and will be referred to herein to describe the features of the insulation 18 and attachment method thereof. However, the steam dispersion tubes 14 are not intended to limit the scope of the invention.

Referring to FIGS. 4-8, a portion of a steam dispersion tube 14 including insulation 18 is shown. As noted previously, although substantially the entire surface of the steam dispersion tube 14 is shown to be covered with insulation 18, in other embodiments, any portion of the outer surface of the steam dispersion tube 14 may be covered with the insulation 18. As noted above, in other embodiments, the inner surface of the steam dispersion tube 14 may be covered with the insulation 18.

Figure 4:
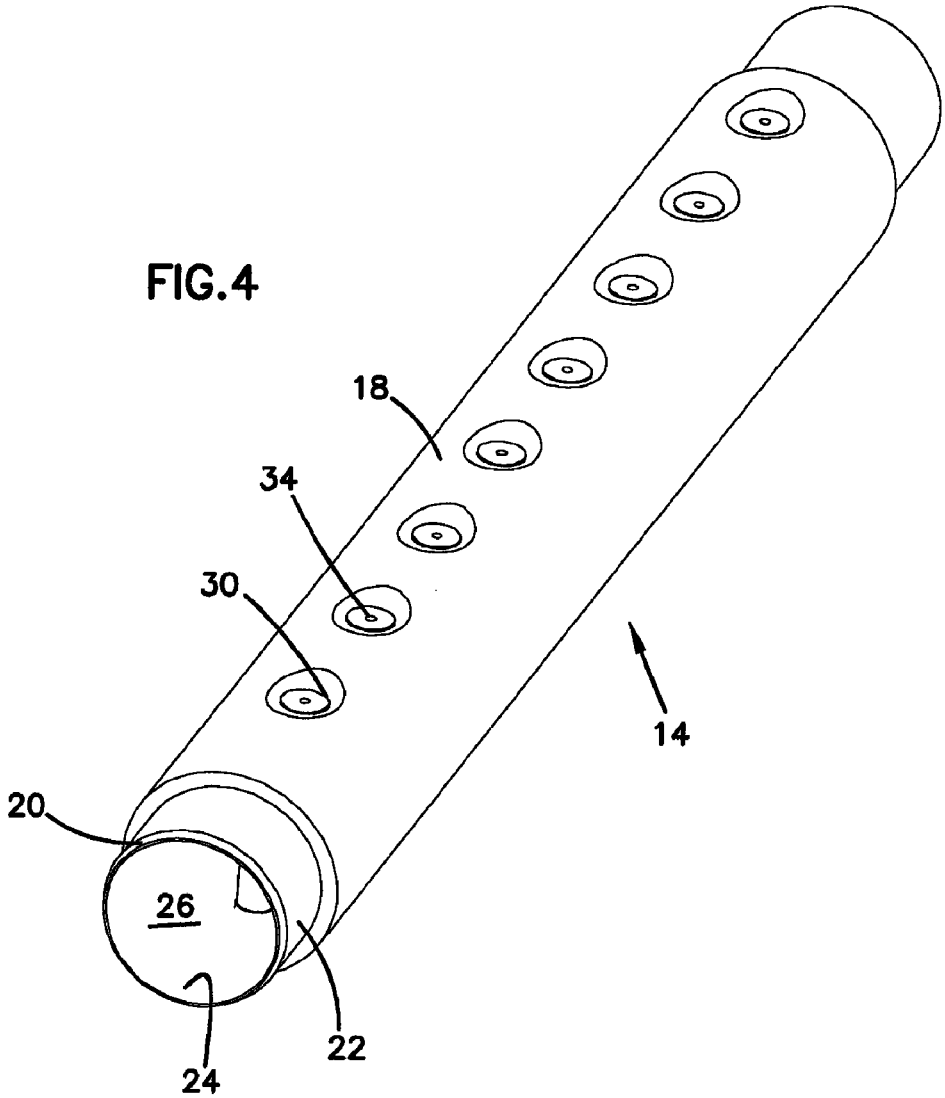
FIG. 4 is a perspective view of a portion of a steam dispersion tube covered with insulation having features that are examples of inventive aspects in accordance with the principles of the present disclosure.

Referring to FIG. 4, the steam dispersion tube 14, as depicted, includes a generally cylindrical wall 20 defining an outer surface 22 and an inner surface 24. In other embodiments, the steam dispersion tubes 14 may be of other shapes, such as square, triangular, elliptical etc. Also, in other embodiments, the steam dispersion tubes 14 may be formed from multiple pieces that are attached together to form the tubes 14.

The steam dispersion tube 14 defines a hollow interior 26 for carrying steam. The steam dispersion tube 14 includes a plurality of openings 28 through the cylindrical wall 20 for emitting the steam. As depicted, the outer surface 22 of the cylindrical wall 20 is covered with insulation 18. The insulation 18 defines a plurality of openings 30 through the insulation 18 that are aligned with the openings 28 of the steam dispersion tube 14.

Figure 7:
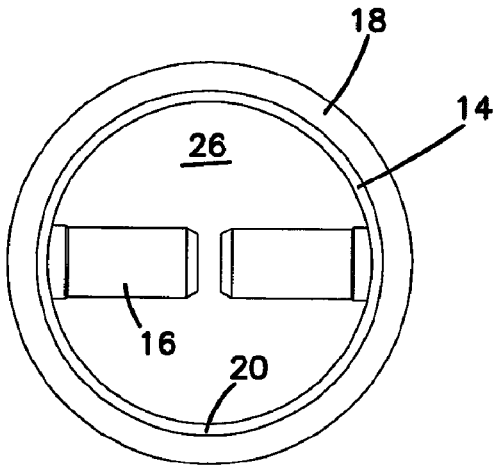
FIG. 7 is a bottom view of the steam dispersion tube portion of FIG. 4, illustrating the internal features of the steam dispersion tube.
Figure 5:
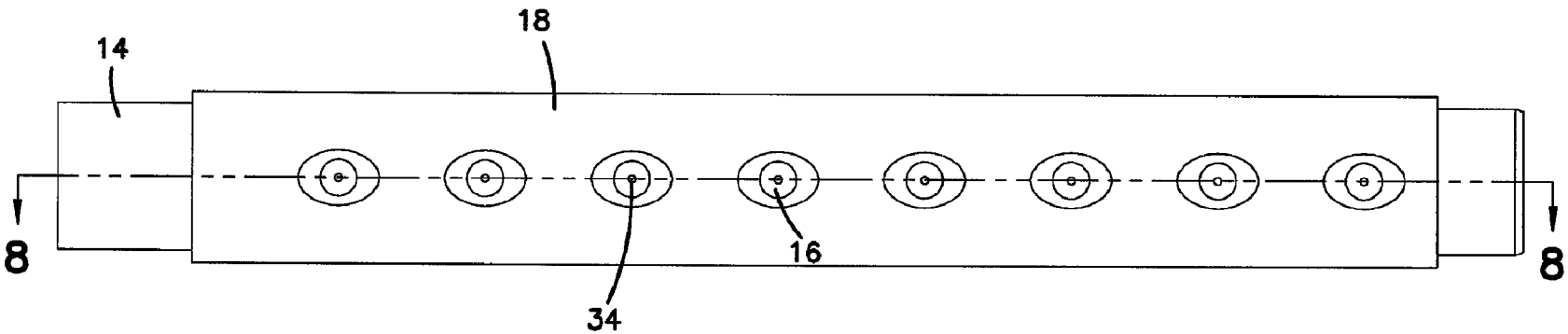
FIG. 5 is a front view of the steam dispersion tube portion of FIG. 4.
Figure 6:
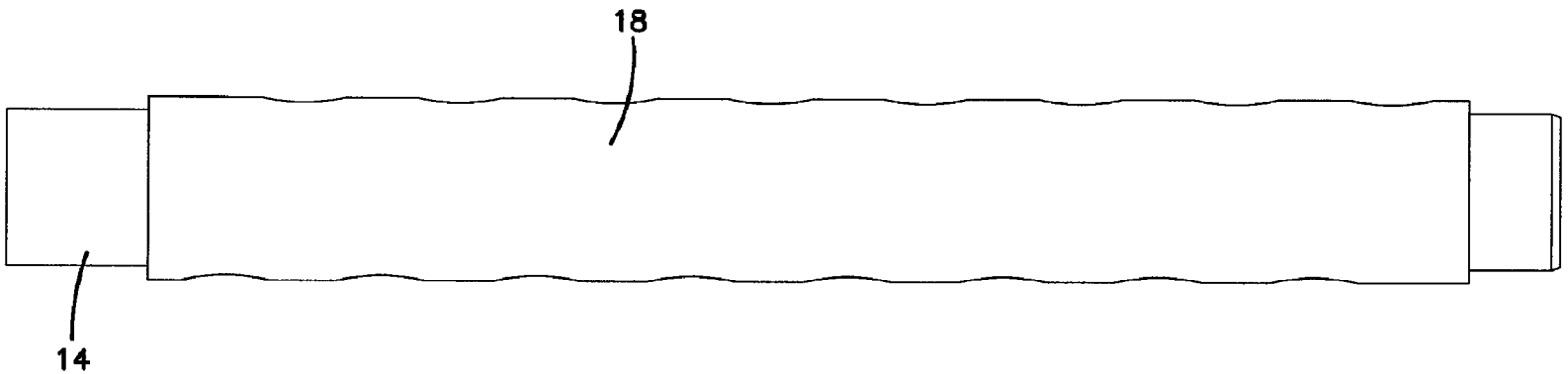
FIG. 6 is a side view of the steam dispersion tube portion of FIG. 4.

As shown in FIG. 7, the steam delivery points 17 of the steam dispersion tube 14 may be defined by nozzles 16 (i.e., tubelets) provided in the openings 28. It should be noted that in other embodiments, the steam delivery points 17 may be defined simply by the openings 28 of the tubes 14 without the use of any nozzles 16.

The nozzles 16, as depicted, are generally cylindrical in shape and project inwardly in a direction from the outer surface 22 to the interior 26 of the steam dispersion tubes 14. Each nozzle 16 defines a throughhole 32 which leads to a steam exit 34. The throughhole 32 is in fluid communication with the hollow interior 26 of the steam dispersion tube 14.

Figure 8:
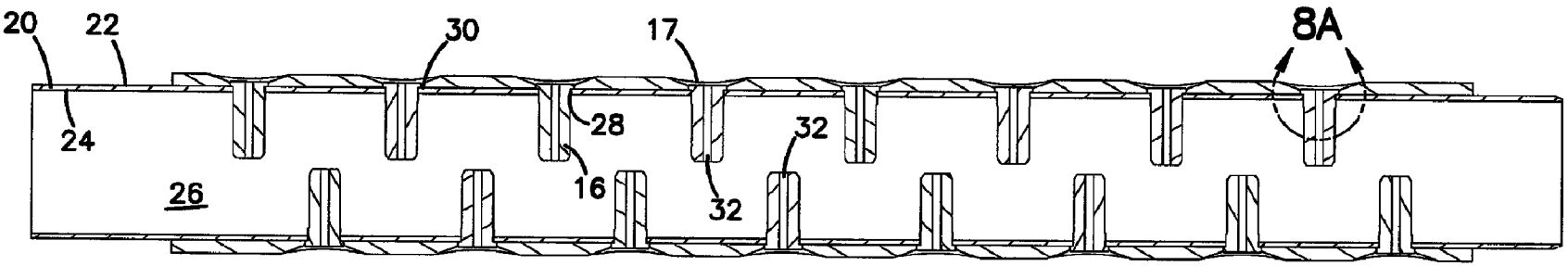
FIG. 8 is a cross-sectional view of the steam dispersion tube portion, taken along line 8-8 of FIG. 5.
Figure 8A:
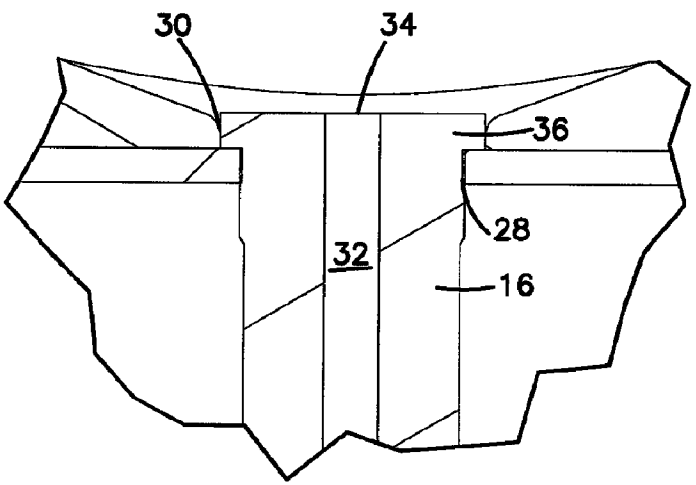
FIG. 8A is close-up cross-sectional view showing a steam dispersion nozzle pressed into a hole through the steam dispersion tube and the insulation of FIG. 4.

As shown in the cross-sectional view in FIGS. 8 and 8A, the nozzles 16 may be coupled to the steam dispersion tube 14 by being press-fit into the openings 28. Each nozzle 16 defines a shoulder 36 that abuts against the outer surface 22 of the cylindrical wall 20 of the steam dispersion tube 14. During the installation of the nozzles 16, a portion of the insulation 18 surrounding the openings 30 may be captured and compressed under the shoulder 36 when the nozzles 16 are pressed in, providing extra securement for the insulation 18.

It should be noted that the nozzles 16 depicted in the embodiment of FIGS. 4-8 is simply one non-limiting example structure for exiting the steam from the dispersion tubes 14. Other structures are certainly possible. For example, in other embodiments, the nozzles 16 may be formed integrally with the cylindrical wall 20 of the steam dispersion tube 14 instead of being removable. In other embodiments, as discussed above, the steam delivery points 17 may be defined simply by the openings 28 of the tubes 14 without the use of any nozzles 16. In yet other embodiments, a steam dispersion tube 14 may include a fine mesh configuration, a porous material, or a woven material defining hundreds, even thousands, of steam delivery points.

A material that will be suitable for the insulation 18 will preferably be one that meets 25/50 flame/smoke indexes for UL723/ASTM E-84, making it acceptable for use in air ducts/plenums. It has also been found that a material that is suitable for the insulation 18 should preferably be a good insulator, having a low thermal conductivity, preferably, less than about 0.35 Watts/m-K (2.4 in-hr/ft^2 deg F.).

A material that has been identified to meet the above-listed criteria for the insulations 18 is polyvinylidene fluoride (i.e., PVDF) fluoropolymer. A number of polyvinylidene fluoride insulation that are suitable for use with the steam dispersion systems of the present disclosure are available from ZOTEFOAMS Inc., under the model names ZOTEK® F40HT LS foam; ZOTEK® F30 LS foam; ZOTEK® F38 HT foam; ZOTEK® F74 HT foam; and ZOTEK® F75 HT foam.

It has been found that PVDF meets the 25/50 flame/smoke indexes for UL723/ASTM E-84 making it acceptable for use in air ducts/plenums.

PVDF also has low thermal conductivity and a high insulation value and no coverings or sprays are needed to be used with PVDF insulation to make the insulation material UV resistant or flame retardant. For example, the foam available from ZOTEFOAMS Inc., under the model name ZOTEK® F40HT LS foam has the thermal conductivity and R value numbers illustrated in Table 1, wherein R value is thickness of the insulation divided by thermal conductivity.

TABLE 1

| Temperature | Thermal Conductivity | R Value (insulation thickness of ⅛") |
|---|---|---|
| 50° F. | 0.2239 Btu-in/ft^2-hr-Deg F. = 0.0323 Watts/Meter-K = 0.01866 Btu/hr-ft-R | (0.125 in/12 in/ft)/ 0.01866 = 0.56 R-ft^2-h/Btu or R value of 0.56. |
| 122° F. | 0.2558 Btu-in/ft^2-hr-Deg F. = 0.0369 Watts/Meter-K = 0.0213 Btu/hr-ft-R | (0.125 in/12 in/ft)/ 0.0213 = 0.49 R-ft^2-h/Btu or R value of 0.49 |
| 181° F. | 0.2884 Btu-in/ft^2-hr-Deg F. = 0.0416 Watts/Meter-K = 0.0240 Btu/hr-ft-R | (0.125 in/12 in/ft)/ 0.0240 = 0.43 R-ft^2-h/Btu or R value of 0.43 |

It should be noted that thermal conductivity increases with increased temperature, leading to less insulation with increasing temperature.

PVDF also includes other attributes that are considered desirable, not necessarily essential, for the insulation 18. One of these attributes is high temperature stability up to 302F. for a long service life. PVDF is also a material that does not break down when exposed to UV light. PVDF is a closed-cell foam that does not absorb moisture and does not support microbial growth.

PVDF also has minimal undesirable out-gassing. PVDF available from ZOTEFOAMS Inc., under the model names ZOTEK® F40HT LS foam; ZOTEK® F30 LS foam; ZOTEK® F38 HT foam; ZOTEK® F74 HT foam; and ZOTEK® F75 HT foam, for example, are expanded using nitrogen gas, which contributes to the lack of undesirable outgassing.

The PVDF material has been tested and the results indicate the PVDF to reduce the total condensate of a system such as the dispersion system 11 by about 45-60%, wherein the PVDF material reduced the outer surface temperature of the tubes 14 from a temperature of 212F. to around 95F. at 500 fpm and 55F. air temperature, thus reducing heating of the air over 50% than without insulation 18.

Some of the condensate in the system forms in the header. Thus, a 45-60% reduction of the total system condensate means that the percent reduction in condensate from the steam dispersion tubes is actually around 65-70%. These values may vary with different systems, sizes, operating air speeds, and air temperatures.

It should be noted that PVDF is simply one example of an insulation material that is suitable to be used with the steam dispersion system 10 of the present disclosure since it meets 25/50 flame/smoke indexes for UL723/ASTM E-84, making it acceptable for use in air ducts/plenums, and, has a thermal conductivity less than 0.35 Watts/m-K (2.4 in-hr/ft^2 deg F.). Other materials that may include the above-listed attributes and that may be suitable for use with the steam dispersion systems described herein include, but are not limited to, acrylonitrile butadiene styrene (ABS); ceramic; chlorinated polyvinyl chloride (CPVC); elastomerics (rubbers); ethylene-vinyl acetate (EVA); glass; latex; melamine; mineral wool; phenolic; polyamide; polycarbonate; polyethylene; polyicynene; polyimide; polyisocyanurate (PIR); polyolefins; polypropylene; polystyrene; polytetrafluoroethylene (PTFE); polyurethane; polyvinyl chloride (PVC); polyvinyl fluoride (PVF); silicone; and urea-formaldehyde foam (UFFI).

In addition to being provided as a layer or jacket surrounding other materials, these materials listed above may also be covered with layers of other materials to attain the properties noted above. Furthermore, the listed materials may be combined with others of the listed materials to attain the properties noted above.

In one embodiment, the insulation 18 may be provided in strips and may be attached to the outer surface 22 of the steam dispersion tube 14 as separate strips so as to cover substantially the entire outer surface 22. The strip(s) of insulation 18 can be wrapped around the steam dispersion tube 14 in a spiral manner. The strip(s) of insulation 18 can be wrapped around the tube 14 with one straight seam, either butted or overlapped. An overlap or butt joint can be welded by heating the material and joining the material to itself while the surfaces are molten.

In other embodiments, the insulation 18 may be provided in tubular form and may be slid over the outer surface 22 of the steam dispersion tube 14. In such an application, the tubes of insulation may be expanded with pressurized air prior to the steam dispersion tubes 14 being slid into the insulation, after which the pressure can be relieved. The insulation may also be expanded using a liquid or gas other than air.

The insulation 18 may be attached to a steam dispersion tube in a number of different ways including via adhesives, by heating, via mechanical means such as with straps, bands, etc.

In other embodiments, the insulation 18 may be provided in forms other than solid strips or tubular sleeves, such as sprays, spray foams, paint, gels, dips, etc.

In one embodiment, a ⅛ inch-thick layer of insulation 18 may be used with a steam dispersion tube 14 that has a diameter of 1 ½ inches. In another embodiment, a ⅛ inch-thick layer of insulation 18 may be used with a steam dispersion tube 14 that has a diameter of 2 inches. In other embodiments, a thickness less or more than ⅛ of an inch may be used depending on the size of the tubes and the insulation desired.

Figure 9:
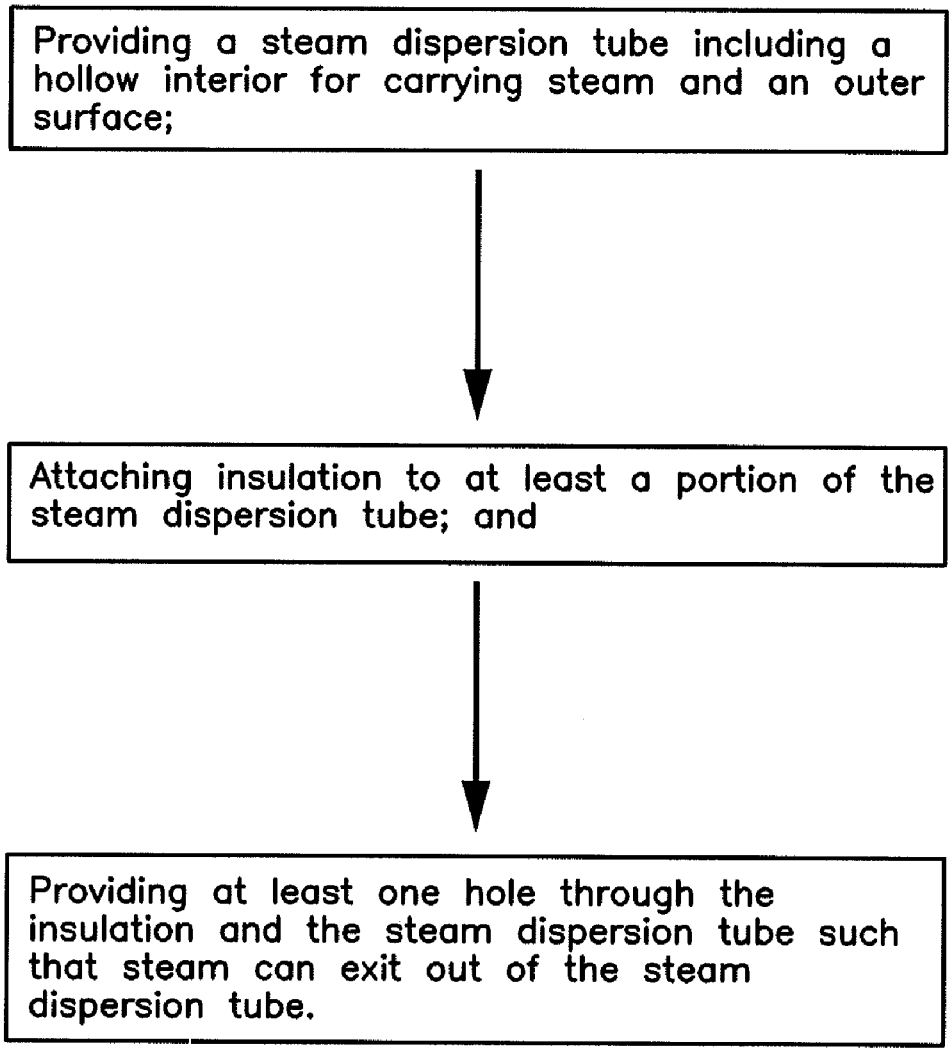
FIG. 9 is a block diagram illustrating a method for attaching insulation to a steam carrying apparatus, the method including features that are examples of inventive aspects in accordance with the principles of the present disclosure.

FIG. 9 diagrammatically shows the steps of one example method for attaching insulation 18 to a steam carrying apparatus (e.g., steam dispersion tube 14). The example method of attachment comprises the steps of applying a piece of insulation 18 to at least a portion (e.g., outer surface) of the steam dispersion tube 14. The insulation 18 can be provided in a number of different forms as described previously. Also, the insulation 18 can be attached to the tube 14 in a number of different ways, as described previously, including via adhesives or other types of bonding materials or via mechanical means such as straps, bands, etc.

After attachment, if the steam carrying apparatus being covered with insulation 18 is a steam dispersion tube 14, one or more holes may be provided through both the insulation 18 and the steam dispersion tube 14. The holes may be provided in the insulation and the steam dispersion tubes by a variety of different methods including punching, drilling, burning (such as with a laser, hot iron, or torch), via water jet, extruding, forming, etc.

In certain embodiments, wherein the use of nozzles 16 is desired, nozzles 16 may be press fit into the hole through the insulation 18 and the steam dispersion tube 14. As discussed previously, the nozzles 16 may include shoulders 36 that capture a portion of the insulation 18 against the outer surface 22 of the steam dispersion tube 14.

The above method of insulation attachment does not require alteration of the manufacturing process of the steam dispersion tubes 14, and, is, thus, cost-effective. The foam wrapped tubes 14 may be run through a tube hole-creating machine just as they would be without any insulation 18. The nozzles 16 may be press fit after the machine creates the holes through the steam dispersion tube 14 and the insulation 18 just as they would be if there were no insulation 18 used.

It should be noted that other alternative methods are also available for attaching the insulation to a steam dispersion tube. For example, in another embodiment, instead of creating the holes through the insulation and the steam dispersion tube simultaneously, the holes can be separately created in the insulation and the steam dispersion tube. The insulation can, then, be attached to the tube, aligning the holes in the insulation with the holes in the dispersion tube.

Although in the aforementioned embodiments, the insulation 18 is described as being provided on at least a portion of a steam carrying apparatus, in other embodiments, the insulation 18 may, itself, form the steam carrying apparatus. In such embodiments, if the provided insulation 18 is rigid enough, other structural enhancements, such as steam dispersion tubes 14, need not be used with the insulation 18 to define a steam dispersion system.

Any of the previously listed insulation materials may be suitable for use with the herein described methods of attaching insulation to a steam dispersion apparatus. The materials may include, but certainly are not limited to, the materials listed above.

The above specification, examples and data provide a complete description of the manufacture and use of the inventive aspects of the disclosure. Since many embodiments of the inventive aspects can be made without departing from the spirit and scope of the disclosure, the inventive aspects reside in the claims hereinafter appended.

We claim:

1. A method of attaching insulation to a steam dispersion tube, the method comprising the steps of:

providing a steam dispersion tube including a hollow interior for carrying steam and an outer surface;

providing insulation on at least a portion of the steam dispersion tube; and creating a hole through the insulation and the steam dispersion tube such that steam carried by the steam dispersion tube can exit out of the steam dispersion tube, wherein the insulation includes polyvinylidene fluoride.

2. A method according to claim 1, further including the step of placing a nozzle within the created hole, the nozzle extending at least partially into the hollow interior of the steam dispersion tube and defining a throughhole in fluid communication with the hollow interior of the steam dispersion tube for exiting the steam.

3. A method according to claim 1, wherein the insulation meets 25/50 flame/smoke indexes for UL723/ASTM E-84.

4. A method according to claim 1, wherein the polyvinylidene fluoride includes a material selected from the group consisting of ZOTEK® F40HT LS foam, ZOTEK® F30 LS foam, ZOTEK® F38 HT foam, ZOTEK® F74 HT foam, and ZOTEK® F75 HT foam.

5. A method according to claim 1, further comprising the step of creating a plurality of the holes through the insulation and the steam dispersion tube after providing the insulation on the steam dispersion tube.

* * * * *